United States Patent [19]

Kimpel et al.

[11] Patent Number: 4,742,610

[45] Date of Patent: May 10, 1988

[54] METHOD FOR ADJUSTMENT-FREE MANUFACTURE OF AN ELECTROMAGNETIC RELAY

[75] Inventors: Rolf-Dieter Kimpel, Berlin; Josef Schweiger, Munich, both of Fed. Rep. of Germany

[73] Assignee: Siemens Aktiengesellschaft, Berlin and Munich, Fed. Rep. of Germany

[21] Appl. No.: 938,528

[22] Filed: Dec. 5, 1986

[30] Foreign Application Priority Data

Dec. 5, 1985 [DE] Fed. Rep. of Germany ..... 3543099

[51] Int. Cl.[4] ..... H01F 7/06

[52] U.S. Cl. ..... 29/602 R; 29/622; 335/81; 335/226

[58] Field of Search ..... 29/602, 622; 156/272.2, 156/273.9, 274.2, 274.4, 274.6, 274.8; 335/80, 81, 87, 128, 220, 270, 276

[56] References Cited

U.S. PATENT DOCUMENTS

| | | | |
|---|---|---|---|
| 2,406,021 | 8/1946 | Little | 29/622 |
| 3,909,210 | 9/1975 | Huttner | 29/622 X |
| 3,949,332 | 4/1976 | Reuting | 335/81 |
| 4,058,783 | 11/1977 | Reuting . | |
| 4,179,798 | 12/1979 | Einbinder et al. | 29/622 |
| 4,577,172 | 3/1986 | Schedele et al. | 29/602 X |

FOREIGN PATENT DOCUMENTS 0140285 5/1985 European Pat. Off. .

*Primary Examiner*—P. W. Echols
*Assistant Examiner*—Andrew E. Rawlins
*Attorney, Agent, or Firm*—Hill, Van Santen, Steadman & Simpson

[57] ABSTRACT

An electromagnetic relay having a contact tongue arranged extending within a base body and switchable between two pole plates, the contact tongue having an end secured by a hard fastening adhesive, the adjustment of the contact tongue between the pole plates occurs by periodically switching an alternating excitation current during solidification of the adhesive.

16 Claims, 2 Drawing Sheets

METHOD FOR ADJUSTMENT-FREE MANUFACTURE OF AN ELECTROMAGNETIC RELAY

BACKGROUND OF THE INVENTION

1. Field of the Invention

The present invention relates to a method for aligning a contact tongue extending through a cavity in an electromagnetic relay body between two pole plates of the relay during manufacturing thereof.

2. Description of the Prior Art

A method of manufacturing an electromagnetic relay is disclosed in German Patent OS No. 33 38 198. The alignment of a contact tongue of the relay between two pole plates is accomplished by means of an air stream generated in the relay body. However, there is a risk that the thin bodied adhesive holding the contact tongue will be negatively influenced by the air stream and will, as such, be distributed in an undesired way under certain conditions. Since the magnitude of the contact spacings of such relays is on the order of 1/10 millimeter, precise alignment of the contact tongue by mechanical means is possible only at a great expense.

SUMMARY OF THE PRESENT INVENTION

An object of the present invention is to provide an extremely precise alignment of a contact tongue between a pair of pole plates during fabrication of a relay in a particularly simple and easy-to-control manner.

This and other objects of the present invention are achieved in a method wherein the contact tongue, or contact spring, of a relay is periodically switched by an alternating magnetic field generated between the contact tongue and two pole plates during solidification of the adhesive until the adhesive has hardened. Thus, no attempt is made in the present method to retain the contact tongue in a middle position between the two pole plates. On the contrary, the contact tongue is intentionally constantly switched with a prescribed frequency. It has turned out that an extremely precise alignment of the contact tongue in the center between the two pole plates is achieved after solidification and hardening of the adhesive.

Since the contact tongue is alternately seated against the two opposing pole faces of the pole plates during solidification of the adhesive, the contact tongue is precisely aligned to the pole faces extremely well. Precise alignment of the contact tongue with the pole faces is quite important since the contact spacing is so small. For example, the spacing of the contacts is on the order of magnitude of 1/10 mm. for such a relay. The precise alignment is acquired in a very simple way with the method of the present invention since the only thing required is alternate excitation to switch the contact tongue, which can be accomplished and controlled at very little expense.

It is advantageous that the alternating excitation is applied during assembly of the contact tongue. As a result of the use of the alternating field to center the contact tongue, the contact tongue is precisely pulled into the narrow air gap between the two pole plates and is aligned therebetween so that the risk of mutual damage to the pole plates and the contact tongue is avoided.

The generation of the alternating magnetic field can be accomplished by coupling the unlike poles of the two pole plates to a permanent magnet arrangement and having the contact tongue periodically switched by means of a coil excited with an alternating current of a prescribed frequency. The permanent magnet arrangement is fashioned as one or more permanent magnets which are directly coupled to the two pole plates, or alternately, are coupled thereto through ferromagnetic yokes.

In general, the relay in which the invention is practiced is a polarized system. In such case, the magnetic system inherent in the relay, namely a permanent magnet arrangement adjacent the pole plates and the excitation winding of the relay applied to the base body, is used for adjustment. However, it is also possible to first use an external permanent magnet in combination with a relay coil instead of the permanent magnet arrangement inherent in the relay which, in such case, is not mounted until later. On the other hand, an external excitation coil can also be coupled to an external permanent magnet arrangement for adjustment during fabrication. In other words, the present method for aligning the relay contact can be practiced prior to complete assembly of the relay by providing the needed external parts.

The excitation current for use in the present method is, for example, the result of a square AC voltage applied to the coil, whether the coil is inherent in the relay or externally coupled. The frequency of the excitation current is preferably either 50 Hz. or 60 Hz., depending on the power supply frequency, since this frequency is the easiest to produce from the main supply voltage. Other frequencies, of course, can be used depending on the mechanical properties of the relay, the properties of the contact tongue, and the hardening speed of the adhesive, which together define the upper and lower limits for the frequencies selected. The pulse-duty ratio of the AC voltage is preferably symmetrically selected, at least when the relay is to have a bistable switching characteristic. When an asymmetrical relay is desired, a non-symmetrical signal is used.

DESCRIPTION OF THE PREFERRED EMBODIMENTS

Figure 1:
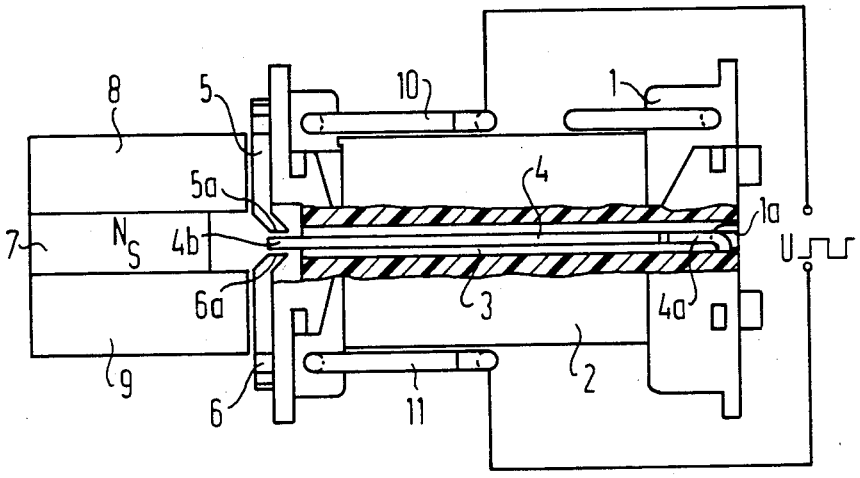
FIG. 1 is a schematic illustration of a relay, including an apparatus for practicing the method of the present invention wherein a coil inherent in the relay is used for adjusting the contact tongue.

FIG. 1 shows a relay, partially in cross section, including a coil body 1 having a winding 2 and a longitudinal through-opening 3 preceding in an axial direction through the coil body 1. A contact tongue or armature spring 4 is disposed extending in an axial direction within the opening 3. The contact tongue 4 has a fastening end 4*a* which is provided with laterally applied fastening tabs which are seated in grooves 1*a* and are secured by a fast hardening adhesive. The exact structure of-the contact tongue and the coil body in this region, and further details of the relay as a whole, are shown in the above-identified German Patent OS No. 33 38 198 and in the corresponding U.S. Pat. No. 4,577,172 issued Mar. 18, 1986 to Schedule et al. disclosing an electromagnetic relay and method for the manufacture thereof. In particular, after being plugged in, the fastening tabs lie loosely and with play in the groove 1*a* of the coil body flange, since the grooves 1*a* are wider than the material thickness of the fastening tabs. Two cut-free edges of the contact tongue 4 respectively lie against seating surfaces of the coil body flange so that a pivot axis arises around which the armature or contact tongue 4 and the fastening tabs as well are pivotable and freely moveable. It need not be a matter of a bearing notch or a bearing edge. On the contrary, the edges of the contact tongue 4 can also slide against the seating surface in order to align precisely in the center of the coil body opening 3.

The contact tongue 4 is switched at a free end 4*b* between two pole plates 5 and 6. The two pole plates 5 and 6 in the finished relay are polarized by a permanent magnet arrangement applied at an end face of the relay. Depending on the direction of the excitation current in the winding 2, the contact tongue 4 is brought into a seating arrangement against the pole plate 5 or, alternately, against the pole plate 6 and is retained there by the permanent magnetic force.

To obtain an optimally identical response of the relay in both switching directions, the contact tongue 4 should preferably have its free end 4*b* positioned precisely in the middle between the two pole plates 5 and 6, that is, without the influence of the permanent magnet arrangement. Furthermore, the contact tongue 4 should have its lateral contact faces aligned as parallel as possible to pole faces 5*a* and 6*a* of the two pole plates 5 and 6, respectively, to actually obtain the intended contact spacing at all locations. For this purpose, it is provided that the contact tongue 4 be aligned in the grooves 1*a* during introduction and hardening of the hard fastening adhesive such that the desired middle position is assumed without subsequent adjustment. This is particularly desirable since later adjustment of the contact tongue 4 is possible only at a relatively great expense in apparatus and adjustment time. Thus, in accordance with the principles of the present method, the precise postion is achieved by periodically switching the contact tongue 4 between the two pole plates with the prescribed frequency during hardening of the adhesive. The prescribed frequency is preferably the power supply frequency, namely 50 Hz. or 60 Hz., depending on the locale.

In accordance with FIG. 1, the periodic switching ensues with a simple arrangement. A permanent magnet 7 is coupled to the pole plates 5 and 6 through two yokes 8 and 9. Subsequently, a voltage U is applied to the excitation winding 2 through terminals 10 and 11 thereof. The voltage U is preferably a symmetrical square wave alternating voltage at the power line frequency, although it should be appreciated that other signal shapes and symmetries can be used. After solidification of the adhesive, the permanent magnet arrangement 7, 8 and 9 is removed. As it turns out, the contact tongue 4 is aligned very precisely between the pole plates 5 and 6, and is parallel relative to the pole faces 5*a* and 6*a*. An optimum double contacting of the relay is, thus, guaranteed through such method.

Of course, the adjustment apparatus of FIG. 1 can be modified. For example, the magnet inherent in the relay can be used with the yokes 8 and 9 instead of the permanent magnet 7 when the production sequence permits. On the other hand, an externally coupled winding can be used instead of the excitation winding 2 inherent in the relay, where the externally coupled winding is, for example, slipped over the two yokes 8 and 9. Such an external winding can also be provided with its own core and, at the face end, a pole face of this core can be coupled to the two yokes 8 and 9.

Figure 2:
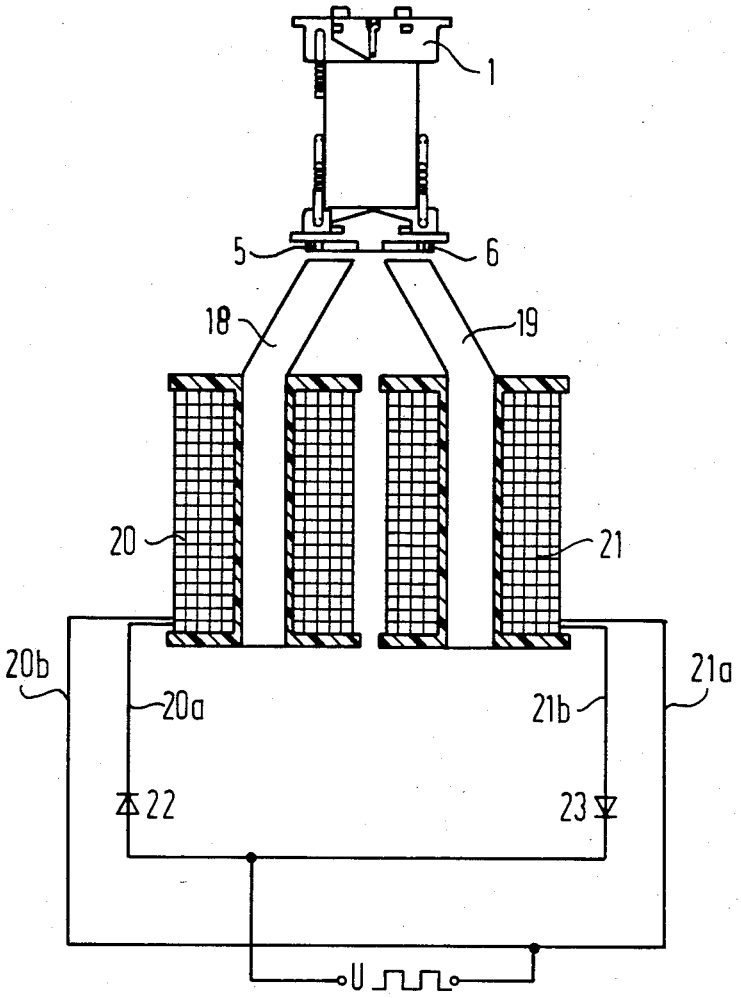
FIG. 2 is a somewhat modified adjustment apparatus for practicing the present inventive method by using an external coil arrangement.

As a fundamental concept, the described adjustment can be undertaken without using a permanent magnet arrangement, as shown schematically in FIG. 2. The relay illustrated therein includes the coil body 1 and the pole plates 5 and 6. Two yokes 18 and 19, each of which includes a coil 20 or 21, respectively, are coupled to the two pole plates 18 and 19. An excitation alternating voltage U is applied through two diodes 22 and 23 between the beginnings of the windings 20*a* and 21*a* and the ends of the windings 20*b* and 21i b. One of the coils 20 and 21 is excited in alternation to couple a magnetic flux to the appertaining pole plate 5 and 6, respectively, through the appertaining yoke 18 and 19, respectively. With this arrangement, the contact tongue (not shown) is periodically switched until the adhesive hardens so that it is aligned in the middle between the two pole plates 5 and 6.

Although other modifications and changes may be suggested by those skilled in the art, it is the intention of the inventors to embody within the patent warranted hereon all changes and modifications as reasonably and properly come within the scope of their contribution to the art.

We claim as our invention:

1. A method for adjustment-free manufacturing of an electromagnetic relay having a contact tongue extending lengthwise through a cavity in a body, a fastening end of the contact tongue having lateral fastening tabs lying loosely and with play in grooves in the body, a free end of the contact tongue extending between the pole plates, comprising the steps of:

applying an adhesive to the fastening end of the contact tongue loosely lying in the grooves; and periodically switching the contact tongue during solidification of the adhesive by an alternating magnetic field generated between the contact tongue and the two pole plates so that the fastening end of the contact tongue moves in the adhesive until the adhesive has hardened.

2. A method as claimed in claim 1, further comprising:

coupling unlike poles of the two pole plates to a permanent magnet arrangement; and periodically switching the contact tongue by a coil excited by an alternating current of a predetermined frequency.

3. A method as claimed in claim 2, wherein said step of periodic switching of the contact tongue includes applying an alternating voltage to an integrated excitation coil of the relay.

4. A method as claimed in claim 2, further comprising: superimposing a field of a coil externally adjacent the pole plates on a permanent magnetic field.

5. A method as claimed in claim 1, further comprising: alternately coupling a magnetic flux to the two pole plates by an electromagnetic arrangement.

6. A method as claimed in claim 1, further comprising: applying an alternating current having a frequency of 50 Hz. to switch the contact tongue

7. A method as claimed in claim 1, further comprising: applying an alternating current having a symmetrical pulse duty ratio for switching.

8. A method as claimed in claim 1, further comprising: applying an alternating magnetic field during mounting of the contact tongue in the base.

9. A method as claimed in claim 1, further comprising: applying an alternating current having a frequency of 60 Hz. to switch the contact tongue.

10. A method as claimed in claim 1, wherein the frequency of periodic switching corresponds to the rate of hardening of the adhesive.

11. A method for aligning a contact spring in an electromagnetic relay between a pair of pole plates, comprising:

placing a fastening and of the contact spring in loose arrangement in a groove of the relay so that a portion of the contact spring extends between the pole plates;

applying an adhesive having a known hardening duration into the groove between the contact spring and the electromagnetic relay; and applying an alternating electromagnetic field to the portion of the contact spring between the pole plates to cause the contact spring portion to switch against alternate ones of the pole plates during at least part of said adhesive hardening duration, the fastening end of the contact spring being freely movable in the groove during said applying of said alternating electromagnetic field until said adhesive hardens.

12. A method as claimed in claim 11, wherein said alternatingly applied electromagnetic field is applied with a frequency depending upon the hardening duration of the adhesive and the mechanical properties of the relay and the contact spring.

13. A method as claimed in claim 11, further comprising:

generating said alternating electromagnetic field from a square wave voltage of symmetrical pulse-duty ratio.

14. A method as claimed in claim 13, wherein said square wave voltage is applied to a coil inherent in the relay.

15. A method as claimed in claim 13, wherein said square wave voltage is applied to a coil arrangement external to the relay.

16. A method as claimed in claim 11, further comprising:

applying said alternating electromagnetic field during insertion of the contact spring between the pole plates.

* * * * *